United States Patent [19]

Clarke et al.

[11] Patent Number: 4,790,422

[45] Date of Patent: Dec. 13, 1988

[54] CONVEYOR SYSTEM FOR ROD-LIKE ARTICLES

[75] Inventors: Peter A. Clarke, London; David C. M. Carter, Coventry, both of England

[73] Assignee: Molins PLC, London, England

[21] Appl. No.: 894,863

[22] Filed: Aug. 8, 1986

[30] Foreign Application Priority Data

Aug. 9, 1985 [GB] United Kingdom ..... 8520104

[51] Int. Cl.[4] ..... B65G 1/00

[52] U.S. Cl. ..... 198/347; 198/601

[58] Field of Search ..... 198/347, 358, 601, 566; 131/282, 283, 909

[56] References Cited

U.S. PATENT DOCUMENTS

| | | | |
|---|---|---|---|
| 4,120,391 | 10/1978 | Molins et al. | 198/347 |
| 4,149,545 | 4/1979 | Hall | 131/283 |
| 4,280,611 | 7/1981 | Molins et al. | 198/347 |
| 4,316,754 | 2/1982 | Hinchcliffe et al. | 198/347 |
| 4,328,886 | 5/1982 | Seragnoli | 198/347 |
| 4,339,025 | 7/1982 | McCombie | 198/347 |
| 4,413,640 | 11/1983 | Wahle et al. | 198/347 |

FOREIGN PATENT DOCUMENTS

| | | | |
|---|---|---|---|
| 1078945 | 3/1960 | Fed. Rep. of Germany | 198/578 |
| 2024758 | 1/1980 | United Kingdom | 198/347 |
| 2029787 | 3/1980 | United Kingdom | 198/347 |
| 2157252 | 10/1985 | United Kingdom | 198/347 |

*Primary Examiner*—Robert J. Spar
*Assistant Examiner*—Cheryl L. Gastineau
*Attorney, Agent, or Firm*—Antonelli, Terry & Wands

[57] ABSTRACT

A conveyor system links two or more cigarette making machines and associated reservoirs with two or more packing machines and includes a first junction to which articles are delivered from at least two makers, a second junction from which articles pass to at least two receiving machines, and a transfer conveyor linking the junctions. The system allows each maker/reservoir to supply either packer but prevents articles passing from one reservoir to the other.

8 Claims, 1 Drawing Sheet

CONVEYOR SYSTEM FOR ROD-LIKE ARTICLES

Figures 1, 2:
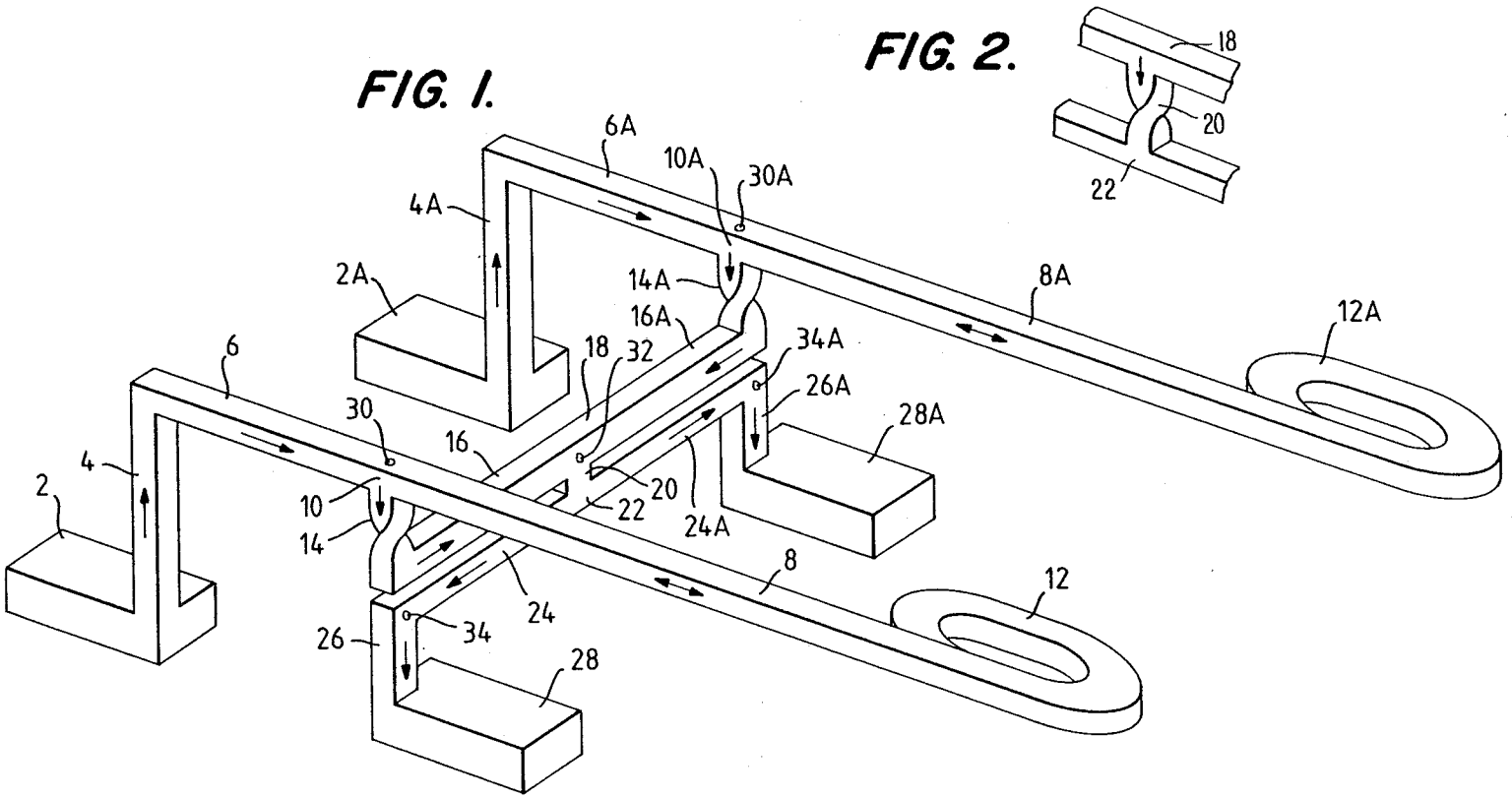

This invention relates to a conveyor system for rod-like articles, particularly a system linking two or more cigarette making machines or cigarette filter rod making machines to two or more cigarette packing machines or filter rod consuming machines.

According to a first aspect of the invention a conveyor system for rod-like articles in multi-layer stack formation extends between a plurality of delivery devices and a plurality of receiving devices and includes first conveyor means including a junction to which articles from at least two delivery devices are delivered in different directions, second conveyor means including a junction from which articles are delivered to at least two receiving devices, and transfer conveyor means linking said junctions.

The first and second conveyor means may comprises substantially horizontal conveyor sections arranged respectively at different levels. In that case preferably the level of the first conveyor means is above that of the second conveyor means. The transfer conveyor means may comprise means for moving articles in stack formation between different levels. For example, the transfer conveyor means may comprise at least one downdrop or chute, which may be twisted.

The delivery devices may comprise machines for producing rod-like articles, e.g. cigarette making machines or filter rod making machines. The receiving devices may comprise cigarette packing machines or filter rod distribution units (e.g. Molins APHIS).

The first conveyor means may include at least one reversible section communicating with a reversible buffer storage device for rod-like articles (e.g. Molins OSCAR) or other reservoir or storage means for articles (e.g. a tray system such as disclosed in British Patent Specification Nos. 2097352, 2142894 or 2157252). A reversible reservoir associated with the first conveyor means may be regarded as a delivery device since it is capable of delivery when unloading rod-like articles. In a preferred arrangement each delivery device is or is associated with a reversible reservoir. The term "reservoir" or "reservoir unit" as used herein is intended to include storage means where the articles are stored in containers (e.g. trays) as well as storage means where the articles are stored in a substantially continuous multi-layer stream.

According to another aspect of the invention a conveyor system for rod-like articles in multi-layer stack formation includes a plurality of delivery devices including at least two reversible reservoir units, a plurality of receiving devices, first conveyor means for delivering articles from said reservoir units to a junction, and second conveyor means for delivering articles from said junction to either of at least two of said receiving devices, at least part of said first conveyor means being unidirectional so that articles cannot be delivered from one reservoir unit to the other reservoir unit.

According to a further aspect of the invention a conveyor system for rod-like articles in multi-layer stack formation includes a plurality of units each comprising a delivery device and an associated reversible reservoir arranged to receive and subsequently discharge excess articles delivered by said device, conveyor means linking at least two units to at least two receiving devices, said conveyor means including a first junction at which streams of articles from said units are combined and a second junction from which streams of articles are delivered to each of said receiving devices, and conveyor means linking said first and second junctions.

According to a still further aspect of the invention a conveyor system for rod-like articles in multi-layer stack formation includes a plurality of delivery devices, a plurality reservoir units, a plurality of receiving devices, and conveyor means linking said delivery devices, reservoir units, and receiving devices, said conveyor means being arranged so that each reservoir unit receives articles only from a delivery device, and each receiving device can receive articles from more than one reservoir unit. Preferably each reservoir unit receives articles only from an associated delivery device. The linking conveyor means may comprise first conveyor means for delivering articles from each delivery device to an associated reservoir unit, and second conveyor means for delivering articles from each delivery device and its associated reservoir unit to more than one receiving device.

According to a still further aspect of the invention a conveyor system for conveying rod-like articles in multi-layer stack formation between a plurality of delivery devices and a plurality of receiving devices comprises first conveyor means for conveying articles from at least two delivery devices, second conveyor means for conveying articles to at least two receiving devices, and transfer conveyor means extending unidirectionally from the first to the second conveyor means. Preferably the first conveyor means is at a first level and the second conveyor means is at a second level. In a preferred arrangement each delivery device has an associated reversible reservoir unit. The first conveyor means may include a junction to which articles are delivered from the delivery device and between which and the reservoir unit articles are conveyed.

The transfer conveyor means may comprise at least one conveyor extending between different levels. Where the first and second conveyor means are arranged at different levels the transfer conveyor means may extend between said levels. In a preferred arrangement the transfer conveyor means comprises a downdrop or chute, which may be twisted. The first and second conveyor means may therefore comprise non-parallel sections immediately adjacent said transfer conveyor means. The transfer conveyor means may extend between T-junctions on said first and second conveyor means.

The invention will be further described, by way of example only, with reference to the accompanying diagrammatic drawings in which FIG. 1 is a perspective view of a conveyor system for rod-like articles and FIG. 2 is a detailed view of a modified downdrop.

A first cigarette making machine 2 supplies a mass flow stream of cigarettes to an elevator 4 leading to an upper horizontal conveyor 6. The conveyor 6 and a reversible conveyor 8 at the same level meet at a T-junction 10. The conveyor 8 communicates with a reversible reservoir 12, which may be similar to Molins OSCAR. A twisted downdrop 14 extends from the junction 10 to a further conveyor 16 arranged at 90 degrees to the conveyors 6, 8 and leading to a further T-junction 18.

A second cigarette making machine 2A and reservoir 12A are interconnected in a similar way by similar conveyors; similar parts have been given the same reference number but with the additional suffix A.

The conveyors 16, 16A meet at the T-junction 18, from which a straight downdrop 20 extends to an inverted T-junction 22. Conveyors 24, 24A lead from junction 22 respectively to chutes 26, 26A of respective cigarette packing machines 28, 28A.

Movement of articles on the conveyors is unidirectional, with the exception of the reversible conveyors 8, 8A and conveyors of the reservoirs 12, 12A.

The horizontal conveyors comprise driven endless band conveyors. The speeds of the conveyors 6, 8 and 6A, 8A are respectively controlled by level sensors 30,30A at the T-junctions 10, 10A. The speeds of the conveyors 16, 16A are similarly controlled by a level sensor 32 at the junction 18. Again similarly, the conveyors 24, 24A are respectively controlled by level sensors 34, 34A above the chutes 26, 26A.

The downdrop 20 may be twisted, as seen in FIG. 2. One or both of the downdrops 14, 14A could be straight, depending on the required orientation of the machines 2, 2A, 28, 28A and reservoirs 12, 12A.

Each reservoir 12, 12A receives cigarettes only from its respective associated making machine 2, 2A. Each packing machine, 28, 28A may receive cigarettes from each making machine 2, 2A and from each reservoir 12, 12A. It is not possible for cigarettes which have entered one of the reservoirs 12, 12A to reach the other reservoir.

We claim:

1. A conveyor system for rod-like articles in multilayer stack formation, comprising a plurality of delivery devices including at least two reversible reservoir units, a plurality of separately driven receiving devices for performing independent operations on said rod-like articles, first conveyor means for delivering articles from said reservoir units, means defining a junction for receiving articles in opposite directions from the first conveyor means, and second conveyor means for delivering articles in opposite directions from said junction to either of at least two of said receiving devices, said first conveyor means having at least a portion comprising unidirectional conveyor means disposed between each reservoir unit and said junction, so that articles cannot be delivered from either reservoir unit to the other reservoir unit.

2. A conveyor system as claimed in claim 1, wherein said first and second conveyor means comprise substantially horizontal conveyor sections arranged at different levels.

3. A conveyor system as claimed in claim 1, including an article delivery device associated with each reversible reservoir unit, wherein said first conveyor means includes means for supplying articles to said reservoir unit only from said associated delivery device.

4. A conveyor system for conveying rod-like articles in multi-layer stack formation, comprising a plurality of article delivery devices, a plurality of separately driven article receiving devices for performing independent operations on said rod-like articles, delivery conveyor means for conveying articles from at least two article delivery devices and having at least a unidirectional portion, receiving conveyor means for conveying articles to at least two article receiving devices, said delivery conveyor means having a first junction zone and said receiving conveyor means having a second junction zone, and transfer conveyor means extending unidirectionally from the first to the second conveyor means and linking said first and second junction zones for transferring articles from any of said article delivery devices to any of said article receiving devices, said transfer conveyor means extending substantially vertically between a T-junction at said first junction zone and an inverted T-junction at said second junction zone.

5. A conveyor system as claimed in claim 4, wherein the transfer conveyor means includes means for changing the orientation of articles.

6. A conveyor system as claimed in claim 4, wherein at least one article delivery device comprises a producing machine and a storage means and first conveyor means linking said producing machine and storage means to said delivery conveyor means.

7. A conveyor system as claimed in claim 4, wherein the transfer conveyor means includes a twisted chute.

8. A conveyor system as claimed in claim 4, including a reversible reservoir unit associated with each delivery device.

* * * * *